US006295953B1

(12) United States Patent
Ohsawa et al.

(10) Patent No.: US 6,295,953 B1
(45) Date of Patent: Oct. 2, 2001

(54) PORTABLE POWER WORKING MACHINE

(75) Inventors: Hisato Ohsawa; Hirofumi Yamami, both of Tokyo (JP)

(73) Assignee: Kioritz Corporation, Ohme (JP)

( * ) Notice: Subject to any disclaimer, the term of this patent is extended or adjusted under 35 U.S.C. 154(b) by 0 days.

(21) Appl. No.: 09/524,672

(22) Filed: Mar. 13, 2000

(30) Foreign Application Priority Data

Mar. 15, 1999 (JP) ..... 11-068880

(51) Int. Cl.[7] ..... F01P 1/02

(52) U.S. Cl. ..... 123/41.7; 123/198 E; 437/DIG. 14; 437/DIG. 28

(58) Field of Search ..... 123/41.7, 41.56, 123/198 E, 437; 55/DIG. 14, DIG. 28, 437

(56) References Cited

U.S. PATENT DOCUMENTS 5,317,997 6/1994 Tomiaku ..... 123/41.7
5,746,160 * 5/1998 Stark et al. ..... 123/41.7

* cited by examiner

*Primary Examiner*—Noah P. Kamen

(57) ABSTRACT

A portable power working machine includes a small air-cooled internal combustion engine, a cooling fan, and a carburetor chamber housing therein an air cleaner. A dust-separating air duct is interposed between a region close to the cooling fan and the carburetor chamber housing, the dust-separating air duct being configured to separate dust included in an intake air from air by taking advantage of an air flow, thereby allowing clean air separated from the dust to be fed to the carburetor chamber housing and allowing the dust separated from the intake air to be sucked by the cooling fan.

5 Claims, 5 Drawing Sheets

PORTABLE POWER WORKING MACHINE

BACKGROUND OF THE INVENTION

The present invention relates to a portable power working machine, such as a chain saw, a brush cutter, a hedge trimmer, and the like, in which the working components are driven by an internal combustion engine. In particular, the present invention relates to a portable power working machine that is constructed to prevent as much as possible an air cleaner attached to an air intake system of the internal combustion engine from becoming clogged with dust.

A conventional portable power working machine, such as a chain saw, generally has a small air-cooled internal combustion engine for driving the working components, such as a saw chain. The engine is mounted in a main housing. A cooling fan driven by the internal combustion engine is disposed on one side of the main housing. A carburetor chamber containing an air cleaner and a carburetor is mounted on an upper rear side of the internal combustion engine.

In the operation of a portable power working machine of the type described above, dust that includes sawdust of relatively large size, powder of cut material and sand-like dust are inevitably generated. When dust of those kinds is allowed to enter together with air into the air intake system of the internal combustion engine and to collect on the filter element of the air cleaner, clogging of the filter results. Clogging causes irregularities in the operation of the engine as well as a deterioration in the performance of the engine due to an insufficiency in the flow rate of intake air. Accordingly, it is required in the operation of the portable power working machine to frequently clean the air cleaner, which is a task that is quite troublesome for the operator.

BRIEF SUMMARY OF THE INVENTION

The present invention has been made to solve the aforementioned problems. In particular, it is an object of the present invention to provide a portable power working machine which is capable of preventing as much as possible the air cleaner of the air intake system of a small air-cooled internal combustion engine acting as a driving power source for working components from becoming clogged with dust, thereby relieving an operator from the task of frequently cleaning the air cleaner.

With a view to attaining the aforementioned object, there is provided, in accordance with the present invention, a portable power working machine having a small air-cooled internal combustion engine received in a main housing. A cooling fan which is driven by the internal combustion engine is located on one side of the main housing. A carburetor chamber containing an air cleaner for the internal combustion engine and a carburetor is mounted on the engine. A dust-separating air duct is interposed between a region close to the cooling fan and the carburetor chamber housing. The dust-separating air duct is configured to separate dust contained in the intake air from air by taking advantage of an air flow, thereby allowing clean air separated from the dust to be delivered to the carburetor chamber housing and allowing the dust separated from the intake air to be sucked by the cooling fan.

In a preferred embodiment, the dust-separating air duct includes a downwardly inclined L-shaped rectangular pipe and a partitioning wall member disposed inside the L-shaped rectangular pipe and extending along the longitudinal direction of the L-shaped rectangular pipe toward the carburetor chamber housing. The partitioning wall member partitions the pipe into a dust-separating passageway and a dust-exhaust passageway extending parallel with and below the dust-separating passageway. The dust-separating passageway includes an air inlet port for admitting air, which is open in a direction opposite to that facing an impeller of the cooling fan. The dust-separating passageway further includes an air-feeding port for delivering the air to the carburetor chamber housing, which is formed below a top wall disposed close to the air cleaner of the carburetor chamber housing. The dust-exhaust passageway communicates with the dust-separating passageway through an opening in the partitioning wall member, which is formed close to the top wall and has an outlet port opening close to the impeller. That arrangement allows the dust collected at an inner corner portion of the top wall to be carried by an air flow and then to be discharged from the outlet port by the suction of the cooling fan.

A typical example of a portable power working machine in which the present invention is especially advantageous is a chain saw. The chain saw includes a saw chain set that is located on the side of the main housing opposite from the cooling fan and the carburetor chamber housing and includes a saw chain and a guide bar. Chain saws produce large quantities of dust, which includes relatively large particles. Reducing the rate of accumulation of dust on the air cleaner offers important improvements in the chain saw.

In the aforementioned preferred embodiment of the portable power working machine, a juxtaposed structure consisting of the overlying dust-separating passageway and the underlying dust-exhaust passageway formed by the partitioning wall member is mounted, as a dust-separating air duct structure, on one side (the cooling fan side) of the main housing. Accordingly, when the power working machine is operated, the cooling air that has been introduced from one side of the main housing by the suction of the cooling fan and hence accelerated and pressurized is transmitted so as to cool the internal combustion engine. The air is then discharged through a discharge port formed in the main housing to the external atmosphere. The air introduced into the carburetor chamber housing is drawn in through the air cleaner so as to be mixed with a fuel to form an air-fuel mixture. The air-fuel mixture is introduced into the intake port of the internal combustion engine.

Since the pressure of air in the carburetor chamber housing is lower than the air pressure in the vicinity of the cooling fan, external air containing dust, such as sawdust of relatively large size, is drawn into the dust-separating passageway of the dust-separating air duct structure from the air inlet port during the intake stroke of the engine. Because the dust-separating passageway is of a downwardly inclined L-shape and is partitioned by the partitioning wall member, the dust, such as sawdust, entrained in the external air is separated from the air. In at regard, the dust is caused to move straight ahead by its inertia and flows along the partitioning wall member and reaches the region in the vicinity of the top wall. Air largely free of dust is discharged into the carburetor chamber housing through a side opening formed below a top wall, which is disposed close to the air cleaner.

The dust that reaches a region in the vicinity of the top wall is then picked up by an air flow generated by the suction of the cooling fan, so that the dust is caused to enter through the opening formed in the vicinity of the top wall into the dust-exhaust passageway formed underneath the dust-separating passageway by the partitioning wall member. Further, due to the suction force of the cooling fan, the dust introduced into the dust-exhaust passageway in this manner is then allowed to pass through the outlet port formed close to the impeller and discharged together with the engine cooling air from the discharge port of the main housing into the external atmosphere.

As mentioned above, since the portable power working machine according to the present invention is featured in that a dust-separating air duct is interposed between a region close to the cooling fan and the carburetor chamber housing so as to separate dust included in an intake air from air by taking advantage of an air flow, clean air separated from the dust is supplied to the carburetor chamber housing. Dust separated from the intake air is sucked by the cooling fan. Thus, clogging of the air cleaner is minimized, and frequent cleaning of the air cleaner is unnecessary, which improves the efficiency of the work performed with the machine.

Additionally, since the intake passage becomes relatively longer due to the provision of the dust-separating air duct, the noise of air-intake can be also minimized.

For a better understanding of the present invention and further advantages thereof, reference may be made to the following description of an exemplary embodiment, taken in conjunction with the accompanying drawings.

DESCRIPTION OF THE EMBODIMENT

Figure 1:
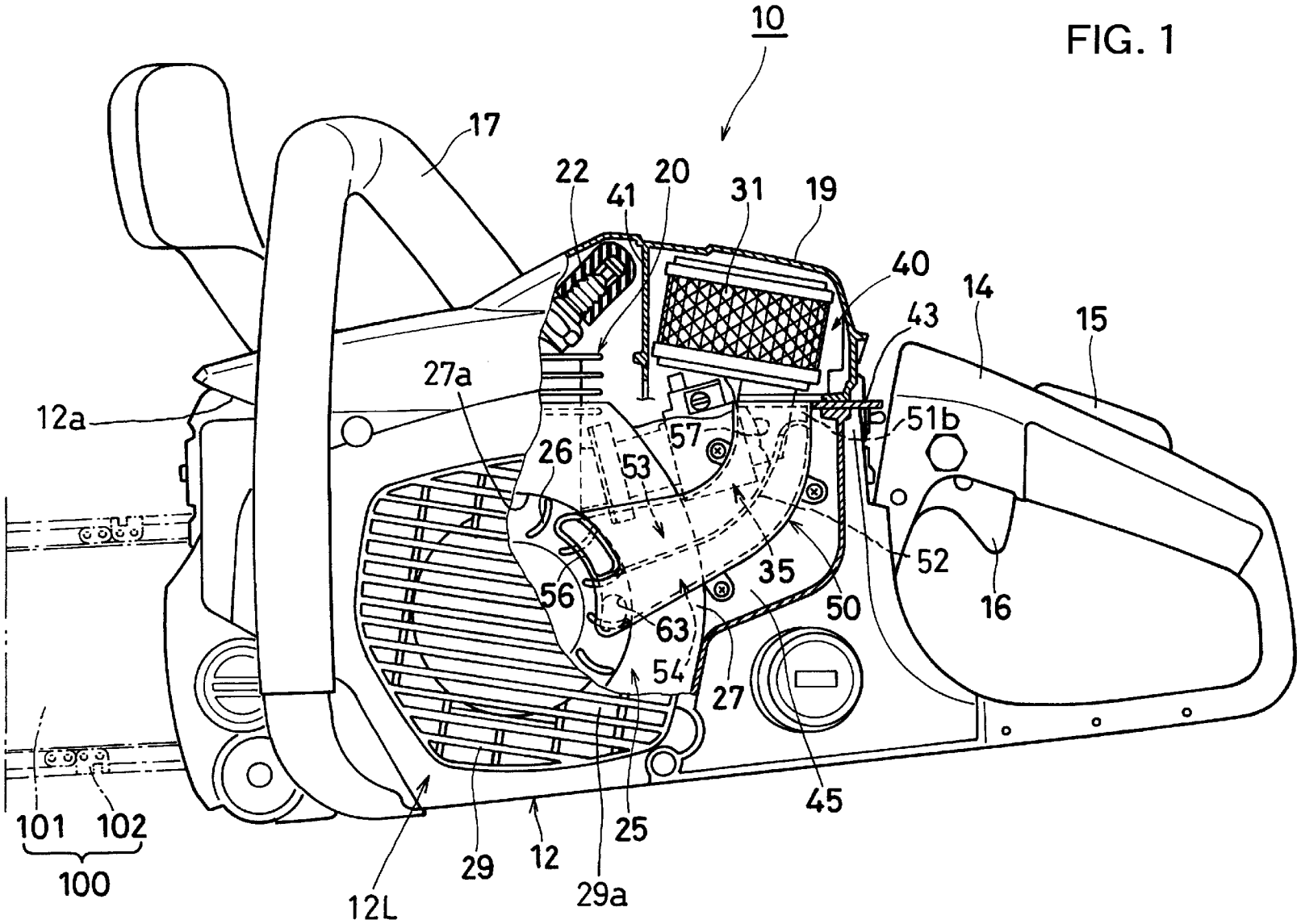
FIG. 1 is a partially sectioned longitudinal view showing the left side of a chain saw representing one embodiment of a portable power working machine according to the present invention.

Referring to FIG. 1, the illustrated embodiment is a chain saw 10, which includes, as a power driving source for actuating working components, a small air-cooled two-stroke gasoline engine 20 (hereinafter referred to as an internal combustion engine). The engine 20 is mounted in approximately the central region of a main housing 12 made of a synthetic resin. The cylinder of the internal combustion engine 20 is vertically oriented. The internal combustion engine 20 is provided, on the top thereof, with an ignition plug 22, which is inclined rearwardly.

A saw chain set 100 composed of a guide bar 101 and a saw chain 102 slidably trained along the guide bar 101 is mounted as a working component on a forward right side 12R (FIG. 2) of the main housing 12. The saw chain 102 is driven by the internal combustion engine 20. Further, disposed on a left side 12L (FIG. 2) of the main housing 12 are a cooling fan 25, which is driven by the internal combustion engine 20, and a recoil starter case 29. The recoil starter case has an air-intake grille 29*a,* which covers an impeller 26 of the cooling fan 25, and a volute case 27. In FIG. 1, the reference number 14 designates a rear handle, 15 a throttle lock lever, 16 a throttle trigger, and 17 a front handle.

A dust-separating air duct 50 is located inside the main housing 12 between the cooling fan 25 and the recoil starter case 29, as well as between the fore-end portion (the main housing 12 side) of the impeller 26 of the cooling fan 25 and a carburetor chamber 40. The carburetor chamber 40 is arranged in air-tight relation at an upper rear side of the internal combustion engine 20. The carburetor chamber 20 contains an air cleaner 31 and a diaphragm type carburetor 35. The dust-separating air duct 50 is generally formed as a downwardly inclined L-shaped rectangular pipe and is designed to separate dust entrained in the intake air from air by taking advantage of an air flow, thereby allowing clean air separated from the dust to be fed to the carburetor chamber housing 40 and allowing the dust separated from the intake air to be sucked by the cooling fan 25.

Figure 3:
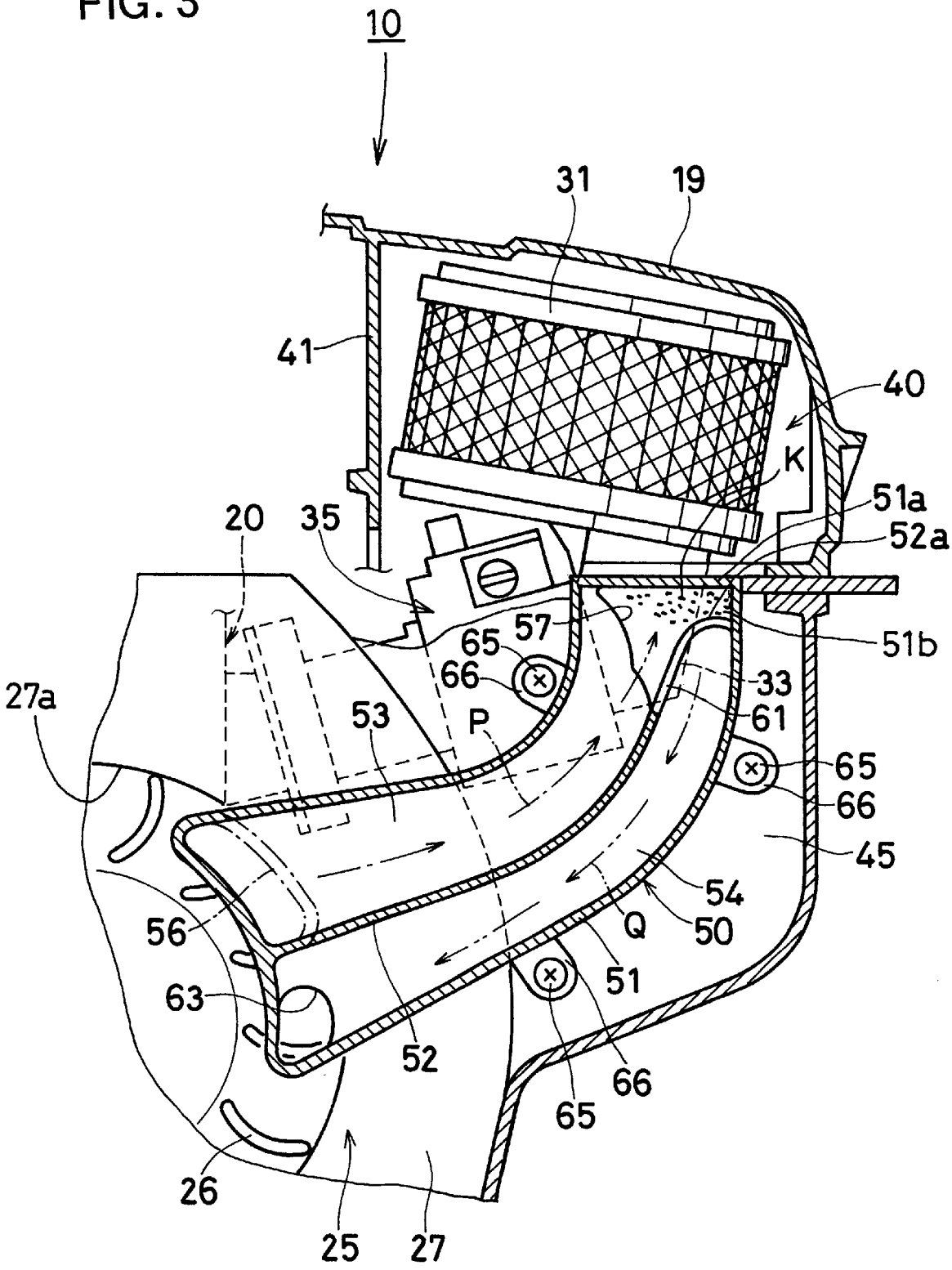
FIG. 3 is an enlarged sectional side view illustrating a main portion of the chain saw shown in FIG. 1.
Figure 4:
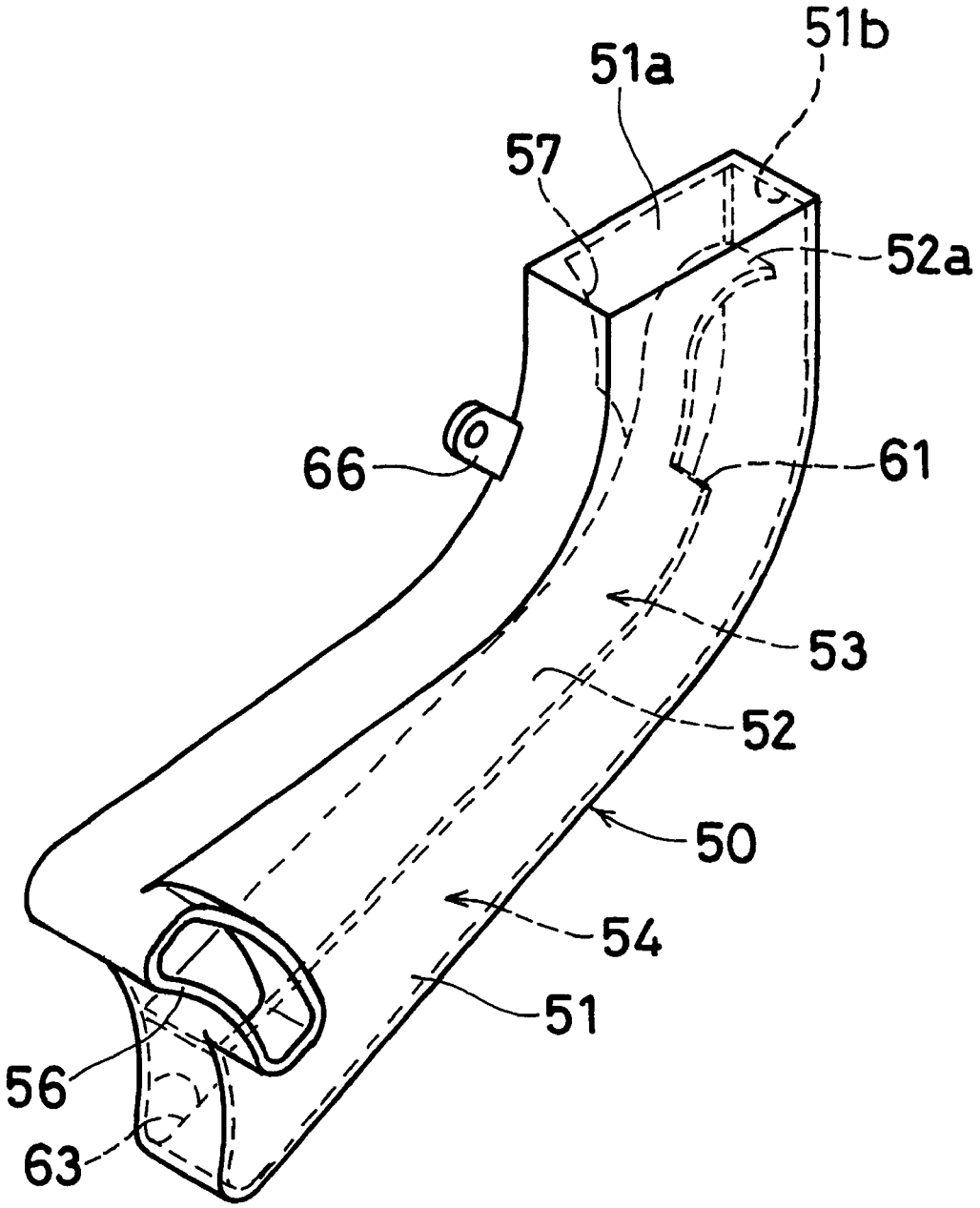
FIG. 4 is a perspective view illustrating the general structure of the dust-separating air duct to be mounted on the chain saw shown in FIG. 1.
Figure 5:
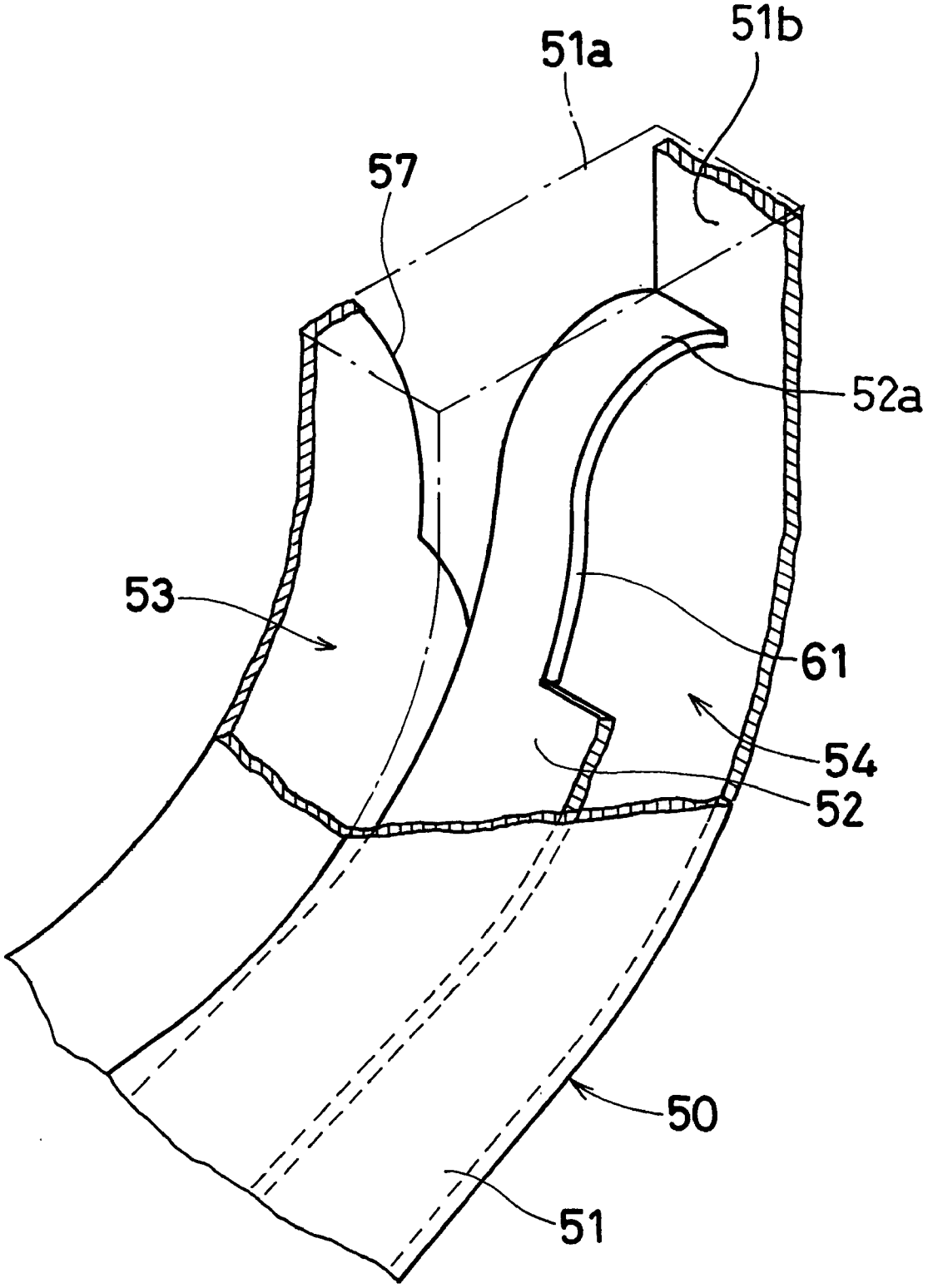
FIG. 5 is a partially sectioned longitudinal enlarged view illustrating the dust-separating air duct shown in FIG. 4.

As clearly shown in FIGS. 3 to 5, the dust-separating air duct 50 is fixed to a perpendicularly extending partition wall 45 of the main housing 12 by screws 65 and mounting pieces 66 attached respectively to three separate portions of an outer wall 51 of the dust-separating air duct 50. The interior of the dust-separating air duct 50 is partitioned into a dust-separating passageway 53 and a dust-exhaust passageway 54, which are juxtaposed one above the other, by a curved partitioning wall member 52.

Figure 2:
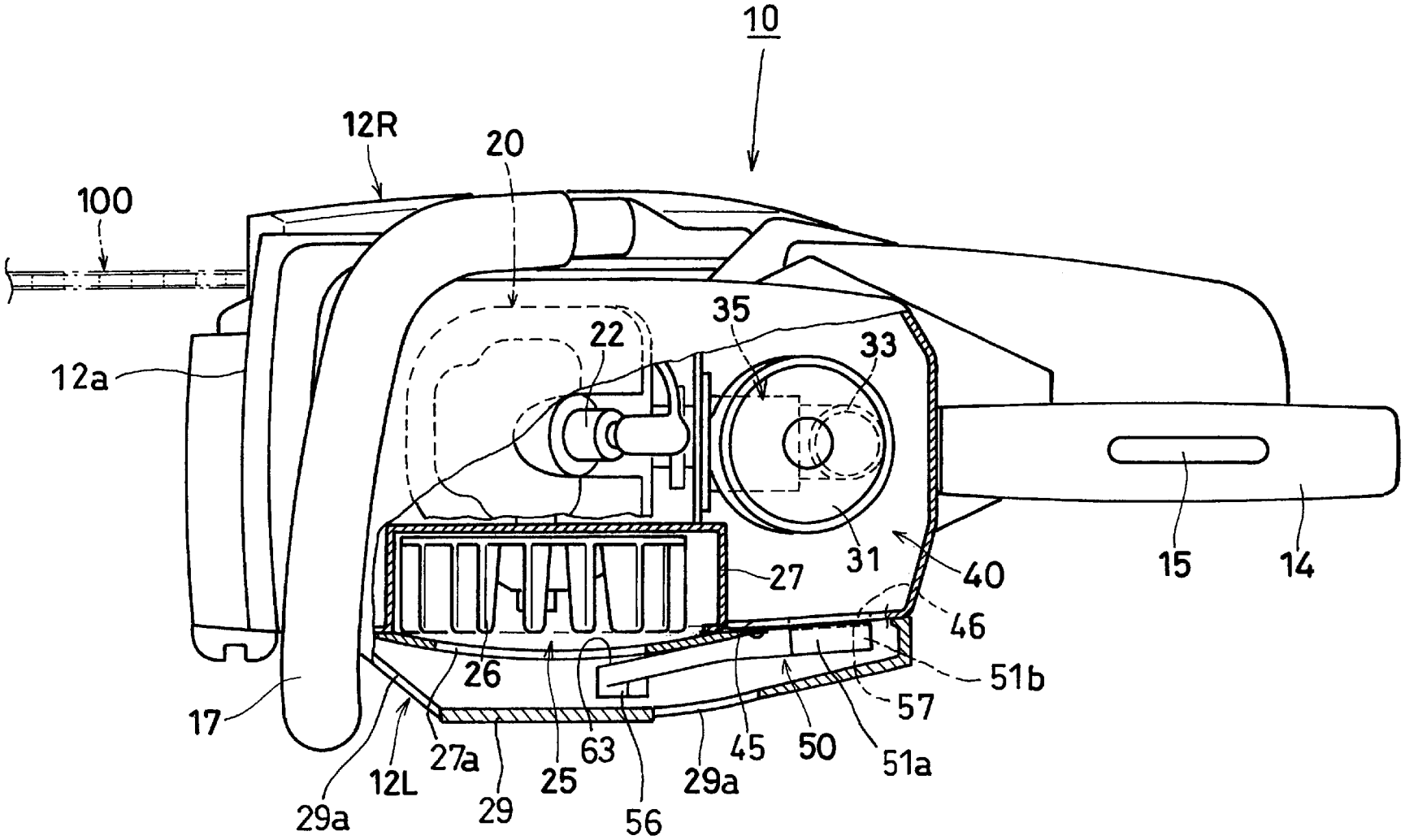
FIG. 2 is a partially sectioned longitudinal plan view showing the top side of the chain saw shown in FIG. 1.

The dust-separating passageway 53 has, within the recoil starter case 29, an air inlet port 56 for admitting external air into the dust-separating passageway 53. The inlet port 56 is open in a direction opposite to that facing the impeller 26 of the cooling fan 25 (i.e., facing toward the outside of the main housing 12). An air feeding port (side opening) 57 having a deformed triangular shape is located below a top wall 51*a* disposed close to the air cleaner 31 of the carburetor chamber housing 40. External air inducted through the air inlet port 56 is delivered from the air feeding port 57 to the carburetor chamber housing 40 by an intake opening 46 formed in the partition wall 45 (FIG. 2).

The dust-exhaust passageway 54 is communicated with the dust-separating passageway 53 by an opening 61 formed in the partitioning wall member 52. The opening 61 is formed close to the top wall 51*a* and is provided with an outlet port 63 located close to the impeller 26, thereby allowing the dust K (FIG. 3) collected at an inner corner portion 51*b* of the top wall 51*a* to be carried by an air flow and then to be discharged from the outlet port 63 by a sucking effect of the cooling fan 25.

The partitioning wall member 52 has an upper end portion 52*a* which is curved into an approximately L-shape and extends up to the inner corner portion 51*b*. About half of the upper end portion 52*a* of the partitioning wall member 52 is cut out to form the opening 61, so that only the other half thereof, which is close to the air feeding port 57, remains.

In the chain saw 10 of the embodiment as constructed above, the dust-separating air duct 50 is mounted on the left side 12L (the cooling fan 25 side) of the main housing 12. Accordingly, when the chain saw 10 is operated, the cooling air that has been introduced through the air intake grille 29*a* of the recoil starter case 29 on the left side 12L of the main housing 12 by the sucking effect of the cooling fan 25 and, hence, accelerated and pressurized is transmitted so as to cool the internal combustion engine 20. The air is then discharged outside through a discharge port 12*a* (FIGS. 1 and 2) formed at a portion of the main housing 12 which is located ahead of the carburetor chamber housing 40 (the internal combustion engine 20 side). The air introduced into the carburetor chamber housing 40 is sucked in through the air cleaner 31 at the time of the intake stroke of the internal combustion engine 20 and is mixed with a fuel to form an air-fuel mixture at the carburetor 35. The air-fuel mixture is introduced into an intake port of the internal combustion engine 20.

Since the pressure of air in the carburetor chamber housing 40 is lower than the air pressure in the vicinity of the cooling fan 25, external air containing dust, such as sawdust, present in front of the impeller 26 of the cooling fan 25 (the recoil starter case 29 side) is drawn into the dust-separating passageway 53 of the dust-separating air duct 50 through the air inlet port 56. The dust-containing air flows along the passageway 53 toward the carburetor chamber housing 40.

Since the dust-separating passageway 53 curves in a downwardly inclined L-shape by the presence of the partitioning wall member 52, the dust K (FIG. 3), such as sawdust, entrained in the external air drawn into the dust-separating passageway 53 is caused to be separated from the air. In that regard, the dust K is caused to move straight ahead in the passageway 53 due to the inertia thereof and to reach the region in the vicinity of the inner corner portion 51*b* of the top wall 51*a*. Thus, air largely free of dust is drawn into the carburetor chamber housing 40 through the side opening 57 formed below the top wall 51*a* disposed near the air cleaner 31 and the intake opening 46 formed in the partition wall 45 (indicated in FIG. 3 by a dot and dash arrow P).

The dust K that reaches a region in the vicinity of the top wall 51*a* is then picked up by an air flow generated by the suction force by the cooling fan 25 (indicated in FIG. 3 by a two dot and one dash arrow Q), so that the dust K is caused to enter through the opening 61 formed in the vicinity of the top wall 51*a* into the dust-exhaust passageway 54 formed underneath the dust-separating passageway 53. Further, due to the suction force of the cooling fan 25, the dust introduced into the dust-exhaust passageway 54 in this manner is then allowed to pass through the outlet port 63 close to the impeller 26 and discharged together with the engine cooling air from the discharge port 12*a* of the main housing 12 into the external atmosphere.

In summary, the chain saw 10 according to the embodiment has a dust-separating air duct 50 interposed between a region close to the cooling fan 25 and the carburetor chamber housing 40 that is configured to separate dust entrained in the intake air from air by taking advantage of an air flow. Thus, clean air separated from the dust is supplied to the carburetor chamber housing 40. The dust separated from the intake air is drawn by the cooling fan 25 through the dust-exhaust passageway 54. Clogging of the air cleaner 31 is minimized, and frequent cleaning of the air cleaner is unnecessary. Hence, the efficiency of use of the chain saw is improved.

Additionally, since the intake passage becomes relatively longer due to the provision of the dust-separating air duct 50, the noise of air-intake can also be minimized.

While in the foregoing one embodiment of the present invention has been explained in detail for the purpose of illustration, it will be understood that the construction of the device can be varied without departing from the spirit and scope of the invention.

For example, although the present invention has been explained in the above embodiment with reference to a chain saw, the present invention is also applicable to other kinds of portable power working machines, such as a brush cutter and a hedge trimmer.

What is claimed is:

1. A portable power working machine, comprising a small air-cooled internal combustion engine received in a main housing, a cooling fan which is adapted to be driven by the internal combustion engine and is disposed on one side of the main housing, a carburetor chamber housing therein an air cleaner for the internal combustion engine and a carburetor, a dust-separating air duct interposed between a region close to the cooling fan and the carburetor chamber, the dust-separating air duct including a partitioning wall member extending along the length of the air duct and forming in the air duct a dust-separating passageway and a dust-exhaust passageway substantially co-extensive with the dust-separating passageway, the dust-separating passageway having an air inlet port for receiving air from the cooling fan and which is open in a direction opposite to that facing the impeller of the cooling fan and an air feeding port for delivering the air to the carburetor chamber formed below a top wall disposed close to the air cleaner of the carburetor chamber, and the dust-exhaust passageway being communicated with the dust-separating passageway by an opening in the partitioning wall member which is formed close to the top wall and has an outlet port opening close to the impeller, thereby allowing the dust collected at an inner corner portion of the top wall to be carried by an air flow and then to be discharged from the outlet port by suction of the cooling fan.

2. The portable power working machine according to claim 1, wherein the dust-separating air duct is generally L-shaped in lateral profile and is inclined upwardly from the cooling fan to the carburetor chamber.

3. The portable power working machine according to claim 1, wherein the dust-separating air duct is of rectangular cross-section.

4. A portable power working machine, comprising a small air-cooled internal combustion engine received in a main housing, a cooling fan which is adapted to be driven by the internal combustion engine and is disposed on one side of the main housing, a carburetor chamber housing therein an air cleaner for the internal combustion engine and a carburetor, a dust-separating air duct interposed between a region close to the cooling fan and the carburetor chamber, the dust-separating air duct being configured to separate dust included in an intake air from air by taking advantage of an air flow, thereby allowing clean air separated from the dust to be fed to the carburetor chamber and allowing the dust separated from the intake air in the air duct to be sucked by the cooling fan, wherein the dust-separating air duct includes a pipe of rectangular cross-section and of L-shape in lateral profile, a partitioning wall member disposed inside the pipe and extending along the length of the L-shaped rectangular pipe toward the carburetor chamber and forming a dust-separating passageway and a dust-exhaust passageway coextensive with and below the dust-separating passageway, the dust-separating passageway having an air inlet port for receiving air therein and which is open in a direction opposite to that facing the impeller of the cooling fan and an air feeding port for delivering the air to the carburetor chamber, the air-feeding port being below a top wall disposed close to the air cleaner of the carburetor chamber, and the dust-exhaust passageway being communicated with the dust-separating passageway by an opening of the partitioning wall member which is formed close to the top wall and comprises an outlet port opening close to the impeller, thereby allowing the dust collected at an inner corner portion of the top wall to be carried by an air flow and then to be discharged from the outlet port by suction of the cooling fan.

5. The portable power working machine according to claim 1, wherein the main housing is provided on a side thereof opposite from the cooling fan with a saw chain set composed of a saw chain and a guide bar.

* * * * *